US008568083B2

(12) United States Patent
Somanath et al.

(10) Patent No.: US 8,568,083 B2
(45) Date of Patent: Oct. 29, 2013

(54) SPOOL SUPPORT STRUCTURE FOR A MULTI-SPOOL GAS TURBINE ENGINE

(75) Inventors: Nagendra Somanath, South Windsor, CT (US); Keshava B. Kumar, South Windsor, CT (US); William A. Sowa, Simsbury, CT (US)

(73) Assignee: United Technologies Corporation, Hartford, CT (US)

( * ) Notice: Subject to any disclaimer, the term of this patent is extended or adjusted under 35 U.S.C. 154(b) by 1055 days.

(21) Appl. No.: 12/554,324

(22) Filed: Sep. 4, 2009

(65) Prior Publication Data

US 2011/0056213 A1 Mar. 10, 2011

(51) Int. Cl.
*F01D 25/16* (2006.01)

(52) U.S. Cl.
USPC ..... 415/69; 415/142; 415/229

(58) Field of Classification Search
USPC ..... 415/68, 69, 142, 191, 208.2, 229; 60/39.08, 796, 797
See application file for complete search history.

(56) References Cited

U.S. PATENT DOCUMENTS

| | | | | |
|---|---|---|---|---|
| 6,082,959 | A | 7/2000 | Van Duyn | |
| 6,708,482 | B2 | 3/2004 | Seda | |
| 7,377,098 | B2 | 5/2008 | Walker et al. | |
| 2007/0231134 | A1* | 10/2007 | Kumar et al. | 415/229 |
| 2007/0237635 | A1 | 10/2007 | Nagendra et al. | |
| 2008/0022692 | A1 | 1/2008 | Nagendra et al. | |
| 2008/0031727 | A1* | 2/2008 | Sjoqvist | 415/142 |
| 2008/0134687 | A1 | 6/2008 | Kumar et al. | |
| 2008/0134688 | A1 | 6/2008 | Somanath et al. | |
| 2008/0276621 | A1* | 11/2008 | Somanath et al. | 60/796 |
| 2009/0120102 | A1 | 5/2009 | Somanath et al. | |

* cited by examiner

*Primary Examiner* — Edward Look
*Assistant Examiner* — Jason Davis
(74) *Attorney, Agent, or Firm* — O'Shea Getz P.C.

(57) ABSTRACT

A gas turbine engine is provided that includes a low pressure spool, a high pressure spool, a stationary support frame, and at least one support arch. The low pressure spool extends between a low pressure compressor and a low pressure turbine. The high pressure spool extends between a high pressure compressor and a high pressure turbine. The spools are rotatable about a center axis of the engine. The support arch has a stationary support mount disposed between a low spool mount and a high spool mount. The support arch is disposed relative to the spools and the stationary support frame so that a load from each spool caused by the rotation of that spool can be transferred to the stationary support frame through the support arch. The support arch can freely rotate about the center axis of the engine relative to the spools and the stationary structural frame.

17 Claims, 3 Drawing Sheets

SPOOL SUPPORT STRUCTURE FOR A MULTI-SPOOL GAS TURBINE ENGINE

BACKGROUND OF THE INVENTION

1. Technical Field

The invention relates to spool support structures used within gas turbine engines in general, and to spool support structures for multi-spool gas turbine engines in particular.

2. Background Information

A gas turbine engine can include a fan, a low pressure compressor, a high pressure compressor, a combustor section, a low pressure turbine, and a high pressure turbine disposed along a common longitudinal axis. The fan and compressor sections work the air drawn into the engine, increasing the pressure and temperature of the air. Fuel is added to the worked air and the mixture is burned within the combustor section. The combustion products and any unburned air subsequently power the turbine sections and exit the engine producing thrust. A low pressure spool (sometimes referred to as an "axial shaft") connects the low pressure compressor and the low pressure turbine. A high pressure spool (sometimes referred to as an "axial shaft") connects the high pressure compressor and the high pressure turbine. The low pressure spool and high pressure spool are rotatable about the longitudinal axis.

It is known to use support frames (e.g., circumferentially distributed struts) to support the low and high pressure spools. The support frames extend radially toward the respective spool and have a bearing disposed at a distal end, which bearing is in contact with the spool. The bearings facilitate rotation of the spools and provide a load path between the spool and the support frame.

The angular momentum ("L") of the axial shaft, which is a function of its angular velocity ("ω"), imparts a torque to the frame to which the bearing is mounted. The torque, in turn, creates shear stress within the frame. To accommodate the torque and concomitant stress, the frame includes a structure often referred to as a "torque box". The torque box accommodates the stress, but adds to the weight and cost of the engine.

What is needed, therefore, is an apparatus for supporting the spools that can accommodate the loadings attributable to the angular momentum of the spools.

DISCLOSURE OF THE INVENTION

According to an aspect of the present invention, a gas turbine engine is provided that includes a low pressure spool, a high pressure spool, a stationary support frame, and at least one support arch. The low pressure spool extends between a low pressure compressor and a low pressure turbine. The high pressure spool extends between a high pressure compressor and a high pressure turbine. The spools are rotatable about a center axis of the engine. The support arch has a stationary support mount disposed between a low spool mount and a high spool mount. The support arch is disposed relative to the spools and the stationary support frame so that a load from each spool caused by the rotation of that spool can be transferred to the stationary support frame through the support arch. The support arch can freely rotate about the center axis of the engine relative to the spools and the stationary structural frame.

According to another aspect of the present invention, a support frame for a gas turbine engine is provided. The gas turbine engine includes a low pressure spool extending between a low pressure compressor and a low pressure turbine, and a high pressure spool extending between a high pressure compressor and a high pressure turbine. The spools are rotatable about a center axis of the engine. The support frame includes a casing, a bearing ring, a plurality of radially extending struts, and a support arch. The bearing ring is disposed radially inside of the casing. The struts are circumferentially spaced apart from one another and extend radially between the bearing ring and the casing. The support arch has a stationary support mount disposed between a low spool mount and a high spool mount. The support arch is disposed relative to the spools and the bearing ring so that a load from each spool caused by the rotation of that spool can be transferred to the bearing ring through the support arch. The support arch is free to rotate about the center axis of the engine relative to the spools and the bearing ring.

These and other objects, features and advantages of the present invention will become apparent in light of the detailed description of the best mode embodiment thereof, as illustrated in the accompanying drawings.

DETAILED DESCRIPTION OF THE INVENTION

Figure 1:
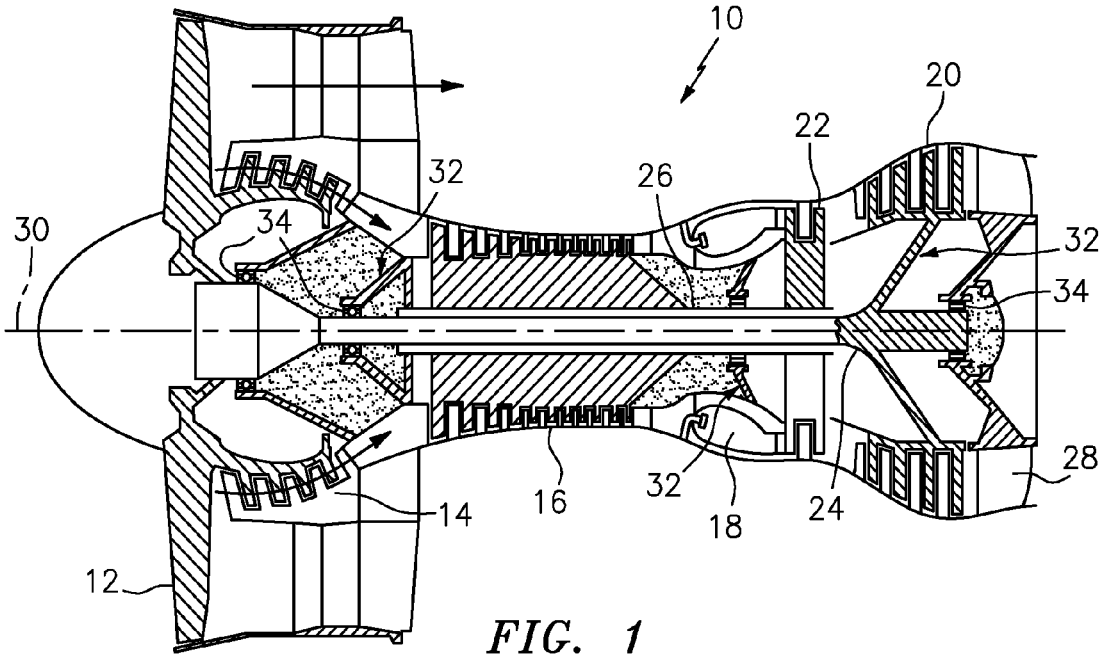
FIG. 1 is a diagrammatic cross-section of a twin spool gas turbine engine.
Figure 2:
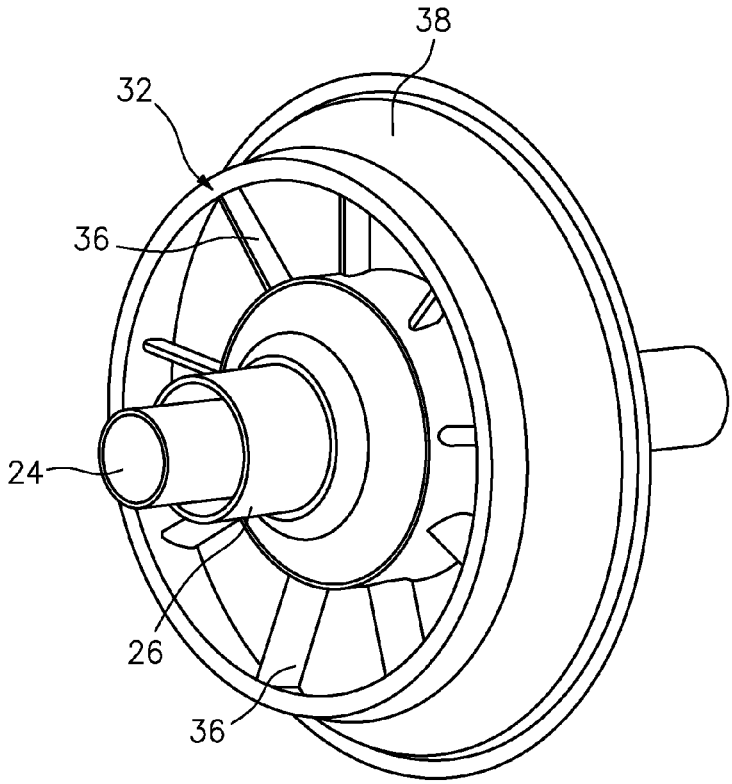
FIG. 2 is a diagrammatic perspective view of a present invention support frame for a gas turbine engine mounted relative to a high pressure spool and a low pressure spool.

Referring to FIGS. 1-2, a gas turbine engine 10 includes a fan 12, a low pressure compressor 14, a high pressure compressor 16, a combustor 18, a low pressure turbine 20, a high pressure turbine 22, a low pressure spool 24, a high pressure spool 26, and a nozzle 28. Each compressor and turbine section 14, 16, 20, 22 includes a plurality of stator vane stages and rotor stages. Each stator vane stage includes a plurality of stator vanes that guide air into or out of a rotor stage in a manner designed in part to optimize performance of that rotor stage. Each rotor stage includes a plurality of rotor blades attached to a rotor disk. The low pressure spool 24 extends between, and is connected with, the low pressure compressor 14 and the low pressure turbine 20. The high pressure spool 26 extends between, and is connected with, the high pressure compressor 16 and the high pressure turbine 22. The low pressure spool 24 and the high pressure spool 26 are concentric and rotatable about the longitudinally extending axis 30 of the engine.

The spools 24, 26 are supported within the engine 10 by one or more stationary structural frames 32 (e.g., a strut) and bearings 34. The structural frames 32 are disposed around the center axis 30 of the engine 10. A structural frame 32 includes a circumferentially solid structure (e.g., having a web that extends around the entire circumference), or it may include a plurality of stationary members 36 (e.g., see FIG. 2) disposed around the circumference (e.g., struts), spaced apart from one another. In the embodiment shown in FIG. 2, the structural members 36 extend radially inward from a casing 38.

Figure 3:
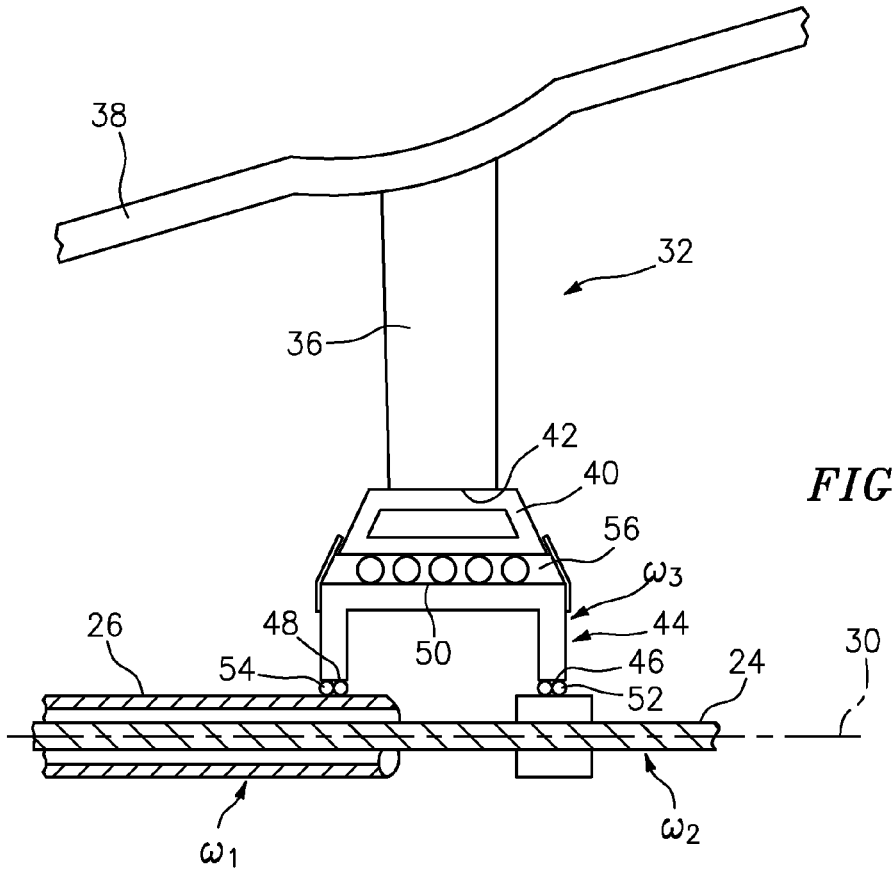
FIG. 3 is a diagrammatic partial sectioned view of a present invention support frame including a rotatable support arch embodiment.
Figure 4:
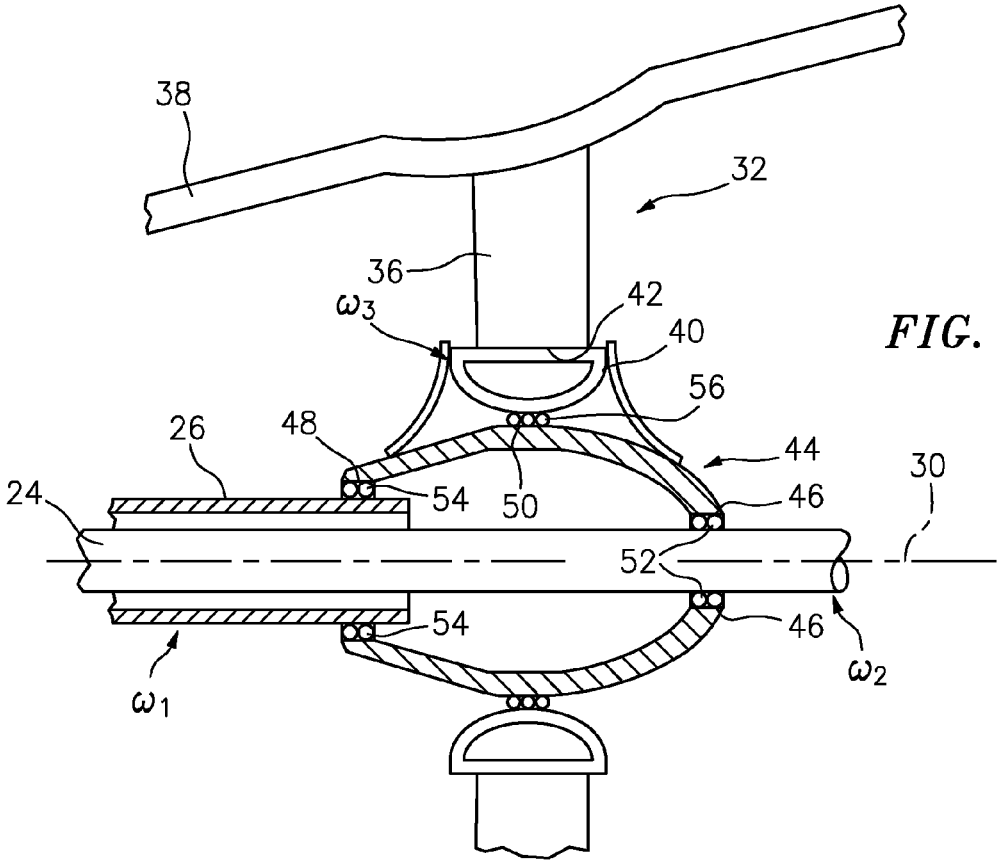
FIG. 4 is a diagrammatic partial sectioned view of a present invention support frame including a rotatable support arch embodiment.

Now referring to FIGS. 3 and 4, in some embodiments a bearing ring 40 (e.g., a hoop-like structure) is attached to the distal end 42 of the structural members 36 (or solid web). In the embodiment shown in FIG. 3, the bearing ring 40 has a trapezoidal cross-section, wherein one of the parallel panels of the trapezoidal ring 40 is fixed to the stationary members 36 (or web) of the structural frame 32. In the embodiment shown in FIG. 4, the bearing ring 40 has a "D"-shaped cross-section, with the flat portion of the "D" fixed to the stationary members 36 (or web) of the structural frame 32. The aforesaid bearing ring cross-section geometries are examples of ring geometries and the present invention is not limited to these examples.

The engine 10 includes a support arch 44 that includes a low spool bearing mount 46, a high spool bearing mount 48, and a stationary support bearing mount 50. As used herein, the term "bearing mount" is used to describe a surface or surfaces to which at least a portion of a bearing can be mounted, or which can be used as part of a bearing (e.g., a race). The stationary support bearing mount 50 is axially disposed between the low and high speed bearing mounts 46, 48. The support arch 44 is disposed between a stationary structural frame 32 (e.g., a continuous web or a bearing ring attached to a plurality of circumferentially spaced members located at an axial position), and the low and high pressure spools 24, 26. The support arch 44 is disposed in a manner that allows the support arch 44 to rotate about the center axis 30 of the engine 10 freely relative to the spools 24, 26 and the stationary structural frame 32. In the embodiment shown in FIG. 3, the support arch 44 has a "U"-shaped annular geometry. In the embodiment shown in FIG. 4, the U-shaped support arch 44 is in the form of a catenary arch annular geometry. The present invention is not limited to either of these configurations.

A low spool bearing 52 is disposed between the low spool bearing mount 46 of the arch 44 and the low pressure spool 24. A high spool bearing 54 is disposed between the high spool bearing mount 48 of the arch 44 and the high pressure spool 26. A stationary support bearing 56 is mounted between the stationary support bearing mount 50 and the stationary structural frame 32. The low and high spool bearings 52, 54 may be mounted on the support arch 44 or the respective spool 24, 26, or some combination thereof, or captured there between and attached to neither. The stationary support bearing 56 may, likewise, be mounted on the support arch 44 or the stationary structural frame 32, or some combination thereof, or captured there between and attached to neither. The bearings 52, 54, 56 and the support arch 44 are mounted in a manner that maintains the axial positions of the bearings 52, 54, 56 and the support arch 44, while at the same time allowing the support arch 44 to rotate freely relative to the spools 24, 26 and the stationary structural frame 32.

Referring to FIG. 1, during operation of the engine 10 air enters the fan 12 (and is subsequently referred to as "core gas flow") and travels through the low and high pressure compressors 14, 16, where it is worked to an elevated pressure and temperature. Fuel is added to the core gas flow in the combustor section 18 and the mixture is ignited. The compressed core gas flow and combustion products enter and power the turbine sections 20, 22, and subsequently exit the engine 10 through the nozzle 28. The "work" extracted from the core gas flow by the high pressure turbine 22 is transmitted to the high pressure compressor 16 by the high pressure spool 26, and the "work" extracted from the core gas flow by the low pressure turbine 20 is transmitted to the low pressure compressor 14 and fan 12 by the low pressure spool 24. The angular velocities of the low pressure spool 24 and the high pressure spool 26 are typically different from one another.

As indicated above, the angular velocity of each spool 24, 26 imparts a torque to the structure supporting the spool 24, 26. The torque and concomitant stress associated with the high pressure spool 26 will exceed that associated with the low pressure spool 24 because the angular velocity ($\omega_H$) of the high pressure spool 26 exceeds the angular velocity ($\omega_L$) of the low pressure spool 24. In the case of an engine 10 having spools supported by conventional stationary support members, the torque is transmitted through the stationary members to a casing (or similar structure) surrounding the support frame, which may be functionally referred to as a "torque box". The casing must be able to accommodate the entire torque loading. In the case of a twin spool engine, the engine must include structure operable to accommodate the torque generated by both spools, independent of one another.

Under the present invention, in contrast, a support arch 44 is disposed relative to the low pressure spool 24, the high pressure spool 26, and a stationary structural frame 32 (e.g., struts 36) located at a particular axial position so that a load (e.g., torque) from each spool 24, 26 caused by the rotation of the spool can be transferred to the stationary structural frame 32 through the support arch 44. The support arch 44 which is mounted in a freely rotatable, but substantially axially constrained manner, rotates at an angular velocity ($\omega_A$) that is less than the angular velocity of either the low pressure spool 24 or the high pressure spool 26 (i.e., $\omega_H > \omega_A > \omega_L$) when the support arch 44 reaches equilibrium speed. As a result, the stationary structural frame 32, which is in communication with the support arch 44 via the stationary support bearing 56, is subject to a torque and concomitant stress that is appreciably less than would be associated with the angular velocity of the high pressure spool 26, or the combination of that associated with both the high pressure spool 26 and the low pressure spool 24. Depending upon the application, the decreased transmitted torque can be accommodated using a torque box or similar structure that is smaller and/or lighter in weight than would be required under conventional designs.

Figure 5:
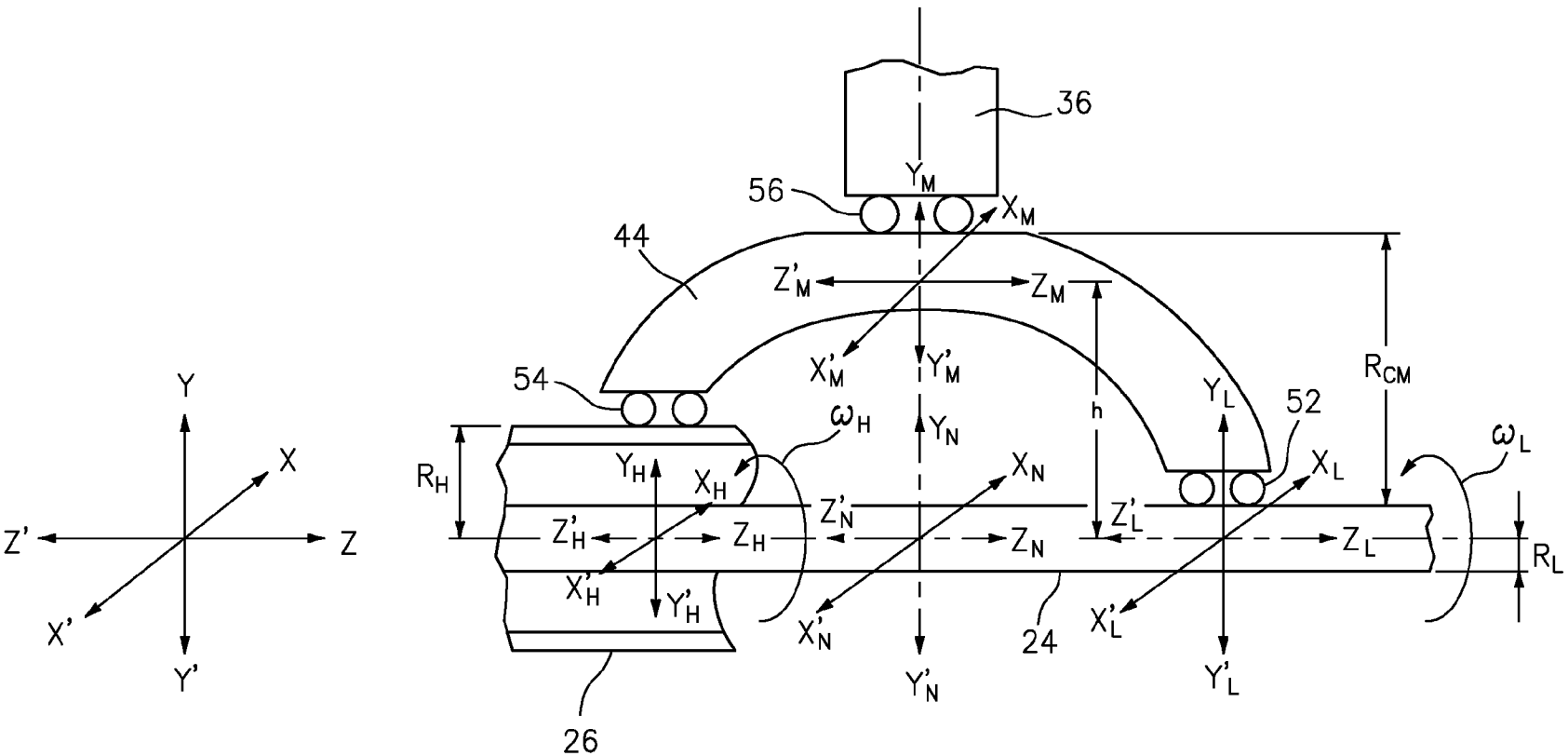
FIG. 5 is a diagram of a high pressure spool, low pressure spool, and support arch, illustrating relative coordinate systems.

The relative angular velocities of the high pressure spool 26, the low pressure spool 24, and the support arch 44 can be illustrated using the conservation of angular momentum. As shown in FIG. 5, the high spool bearing can be viewed as having a co-ordinate system ($X_H$, $Y_H$, $Z_H$), rotating at an angular velocity $\omega_H$ relative to an inertial reference frame (X, Y, Z), and the low spool bearing can be viewed as having a co-ordinate system ($X_L$, $Y_L$, $Z_L$), rotating at an angular velocity $\omega_L$ relative to the inertial reference frame (X, Y, Z). The reference frames are related to each other such that the corresponding axes are parallel each other; e.g., $Z_H$, $Z_L$, and Z are parallel each other. The angular velocity of the high pressure spool 26 is assumed to be faster than the low pressure spool 24 (i.e., $\omega_H > \omega_L$).

As shown in FIG. 5 and described above, bearings 52, 54, 56 are disposed between the support arch 44 and the low pressure spool 24, the high pressure spool 54, and the strut 36, respectively. The support arch 44 has a center of mass located at point "cm" which is the origin of axes ($X_M$, $Y_M$, $Z_M$) that move about a center point ($X_N$, $Y_N$, $Z_N$). In three dimensions, the "point cm" is actually a "line cm". The respective axes ($X_N$, $Y_N$, $Z_N$) are parallel with the axes of the inertial reference frame (X, Y, Z). The angular velocity of the arch $\omega_A$ is determined by the velocity of the center of mass (at point cm).

For purposes of determining the velocity of the support arch 44, the above defined rotational system is assumed to be ideal in the sense that heat losses due to friction of the bearings, heat loss during operation, etc., is assumed to be diminutive and can be neglected. It is also assumed that there is no relative axial position change within the system and any linear velocity is diminutive and therefore can be neglected. These assumptions and this illustration works for both co-rotating spools and counter-rotating spools. Given these assumptions (e.g., no axial change), the system can be considered to be a purely rotational system, one that satisfies the conditions for the conservation of angular momentum.

If the initial momentum of the system ($L_i$) is equal to zero (i.e., $L_i=0$), the final momentum of the system at steady-state velocities can be expressed as:

$$L_f=I_H\omega_H+I_L\omega_L+I_A\omega_A \quad \text{(Eqn. 1)}$$

where the inertia variables for the high pressure spool ($I_H$), the low pressure spool ($I_L$), and the support arch ($I_A$) can be expressed as follows:

$$I_H = \frac{1}{2}M_H R_H^2 \quad \text{(Eqns. 2, 3, 4)}$$

$$I_L = \frac{1}{2}M_L R_L^2$$

$$I_A = \frac{1}{2}M_A R_{CM}^2 + Mh^2$$

where $M_H$ is the mass of the high pressure spool, $M_L$ is the mass of the low pressure spool, $M_A$ is the mass of the support arch, $R_H$ is the radius of the high pressure spool where it contacts the bearing disposed between the high pressure spool and the support arch, $R_L$ is the radius of the low pressure spool where it contacts the bearing disposed between the low pressure spool and the support arch, $R_{CM}$ is the radius of the support arch where it contacts the bearing disposed between the support arch and the strut, and "h" is the radius of the "cm".

Under the conservation of angular momentum, the initial angular momentum is equal to the final angular momentum ($L_i=L_f$). The absolute angular velocity of the support arch can therefore be expressed as:

$$\varpi_A = -\frac{(I_H\varpi_H + I_L\varpi_L)}{I_A} \quad \text{(Eqn. 5)}$$

For a typical application, the following relative equalities can be assumed:

$$\varpi_H > \varpi_L \quad \text{(Eqns. 6, 7, 8, 9)}$$

$$I_L \gg I_H$$

$$I_A > I_H$$

$$I_L > I_A$$

Now rewriting Equation 5:

$$\varpi_A = -\left[\frac{I_H}{I_A}\right]\varpi_H - \left[\frac{I_L}{I_A}\right]\varpi_L \quad \text{(Eqn. 10)}$$

Given the assumed equalities in Equations 6-9, the inertia of the support arch ($I_A$) dominates the $I_H/I_A$ term, and the inertia of the low pressure spool ($I_L$) dominates the $I_L/I_A$ term. The angular velocity of the support arch ($\omega_A$) has a value that lies between the angular velocities of the high pressure spool and the low pressure spool (i.e., $\omega_H>\omega_A>\omega_L$) because the $I_H/I_A$ term is smaller than the $I_L/I_A$ term of Equation 10. The rotational direction of the support arch can be determined by the sign of the support arch angular velocity ($\omega_A$).

The above illustration based on the conservation of angular momentum is an example of how the relative angular velocities can be determined, and can be determined using other means as well; e.g., a conservation of energy analysis.

Specific embodiments of the present apparatus are provided above to illustrate the present apparatus and how the present apparatus may be implemented. Since many changes and variations of the disclosed embodiments of the invention may be made without departing from the inventive concept, these embodiments are not intended to limit the invention otherwise than as required by the appended claims.

What is claimed is:

1. A gas turbine engine, comprising:

a low pressure spool extending between a low pressure compressor and a low pressure turbine;

a high pressure spool extending between a high pressure compressor and a high pressure turbine, wherein the spools are rotatable about a center axis of the engine;

a stationary support frame; and at least one support arch having a stationary support mount disposed between a low spool mount and a high spool mount;

wherein the support arch is disposed relative to the spools and the stationary support frame so that a load from each spool caused by the rotation of that spool can be transferred to the stationary support frame through the support arch, and the support arch can freely rotate about the center axis of the engine relative to the spools and the stationary structural frame at least one stationary support bearing disposed between the stationary support mount and the stationary support frame.

2. The gas turbine engine of claim 1, wherein the at least one support arch is substantially constrained to a predetermined axial position within the gas turbine engine.

3. The gas turbine engine of claim 1, further comprising:

at least one low spool bearing disposed between the low pressure spool and the low spool mount; and at least one high spool bearing disposed between the high pressure spool and the high spool mount.

4. The gas turbine engine of claim 3, wherein the stationary support frame includes a plurality of discrete radially extending struts, circumferentially spaced apart from one another.

5. The gas turbine engine of claim 4, wherein the stationary support frame includes a bearing ring attached to a distal end of each strut, which bearing ring is in communication with the at least one stationary support bearing.

6. The gas turbine engine of claim 5, wherein the bearing ring has a trapezoidal cross-sectional shape.

7. The gas turbine engine of claim 5, wherein the struts extend between the bearing ring and a casing, which casing is disposed radially outside the struts and the bearing ring is disposed radially inside the struts.

8. The gas turbine engine of claim 1, wherein the support arch is annular having the low spool mount disposed on a first axial end, and the high spool mount disposed on a second axial end, and the stationary support mount disposed on a web extending between the first axial end and the second axial end.

9. The gas turbine engine of claim 8, wherein the support arch has a "U"-shaped cross-sectional geometry.

10. The gas turbine engine of claim 9, wherein the support arch has a catenary arch cross-sectional geometry.

11. A support frame for a gas turbine engine, which engine includes a low pressure spool extending between a low pressure compressor and a low pressure turbine, and a high pressure spool extending between a high pressure compressor and a high pressure turbine, wherein the spools are rotatable about a center axis of the engine, the support frame comprising:

a casing;

a bearing ring, disposed radially inside of the casing;

a plurality of radially extending struts, circumferentially spaced apart from one another and extending radially between the bearing ring and the casing; and a support arch having a stationary support mount disposed between a low spool mount and a high spool mount, wherein the support arch is disposed relative to the spools and the bearing ring so that a load from each spool caused by the rotation of that spool can be transferred to the bearing ring through the support arch, and the support arch can freely rotate about the center axis of the engine relative to the spools and the bearing ring.

12. The support frame of claim 11, wherein the support arch is substantially constrained to a predetermined axial position relative to the support frame.

13. The support frame of claim 12, wherein the stationary support mount is adapted to receive at least one stationary support bearing disposed between the stationary support mount and the bearing ring; and wherein the low spool mount is adapted to receive at least one low spool bearing disposed between the low pressure spool and the low spool mount; and wherein the high spool mount is adapted to receive at least one high spool bearing disposed between the high pressure spool and the high spool mount.

14. The support frame of claim 11, wherein the bearing ring has a trapezoidal cross-sectional shape.

15. The support frame of claim 11, wherein the support arch is annular having the low spool mount disposed on a first axial end, and the high spool mount disposed on a second axial end, and the stationary support mount disposed on a web extending between the first axial end and the second axial end.

16. The support frame of claim 15, wherein the support arch has a "U"-shaped cross-sectional geometry.

17. The support frame of claim 16, wherein the support arch has a catenary arch cross-sectional geometry.

* * * * *